US006525664B1

(12) United States Patent
Erland

(10) Patent No.: US 6,525,664 B1
(45) Date of Patent: Feb. 25, 2003

(54) CONTROL CONSOLE REMOTE MONITORING SYSTEM

(76) Inventor: Michael J. Erland, 617 Gardenvale Road, Ottawa, Ontario (CA), K1K 1E5

( * ) Notice: Subject to any disclaimer, the term of this patent is extended or adjusted under 35 U.S.C. 154(b) by 0 days.

(21) Appl. No.: 08/338,235

(22) Filed: Nov. 10, 1994

(51) Int. Cl.[7] ..... G08B 21/00

(52) U.S. Cl. ..... 340/635; 340/539; 340/438; 340/439; 455/67.7; 702/183

(58) Field of Search ..... 340/635, 539, 340/825.5, 825.54, 825.55, 540, 439, 438; 364/424.03, 424.01; 455/67.7, 69, 70

(56) References Cited

U.S. PATENT DOCUMENTS

| | | | | | |
|---|---|---|---|---|---|
| 3,082,413 | A | * | 3/1963 | Freedman | 340/688 |
| 3,720,911 | A | | 3/1973 | Bomar, Jr. | 340/52 |
| 4,560,978 | A | | 12/1985 | Lemelson | 340/539 |
| 4,928,778 | A | | 5/1990 | Tin | 180/167 |
| 5,003,479 | A | * | 3/1991 | Kobayashi et al. | 364/424.03 |
| 5,081,443 | A | | 1/1992 | Breit | 340/426 |
| 5,084,695 | A | * | 1/1992 | Freeman | 340/323 R |
| 5,257,190 | A | | 10/1993 | Crane | 364/424.03 |

* cited by examiner

*Primary Examiner*—Julie Lieu

(74) *Attorney, Agent, or Firm*—Edward W. Callan

(57) ABSTRACT

A portable monitoring unit remotely monitors measurement data provided at a control console that includes a processor adapted for processing measurement data related to a plurality of monitored parameters and for providing an alarm-condition signal when an alarm condition is indicated by such processing. The alarm-condition signal is transmitted by a two-way radio coupled to the control console. The portable unit includes a display device; a keypad for selecting a parameter as to which measurement data is to be displayed by the display device and for enabling the measurement data that is to be displayed to be requested from the control-console processor; a two-way radio for transmitting such request to the radio that is coupled to the control console and for receiving the alarm-condition signal transmitted by the radio that is coupled to the control console; and a processor coupled to the keypad, the portable-unit radio and the display device, and adapted for responding to an operation of the keypad to select a parameter as to which measurement data requested from the control-console processor is to be displayed by causing the portable-unit radio to transmit to the radio coupled to the control console a request for transmission of the measurement data selected by operation of the keypad and for causing the display device to display either the alarm condition or measurement data that is transmitted by the radio coupled to the control console in response to such request and received by the portable-unit radio.

12 Claims, 2 Drawing Sheets

CONTROL CONSOLE REMOTE MONITORING SYSTEM

BACKGROUND OF THE INVENTION

The present invention generally pertains to monitoring measurement data and is particularly directed to monitoring measurement data that is processed at a control console at which an alarm is provided when such processing indicates an alarm condition.

A prior art system for processing monitored measurement data and for providing an alarm when an alarm condition is indicated comprises a control console that includes a processor that is adapted for processing measurement data related to a plurality of monitored parameters in relation to predetermined parameter thresholds and for indicating an alarm condition upon the processed measurement data reaching a said parameter threshold; and means for responding to the alarm-condition indication by sounding or otherwise providing an alarm. A person having responsibility for reacting to said alarm often does so by initially observing and analyzing the monitored measurement data in order to determine how the alarm condition might be alleviated. Such responsible person also reacts to the alarm by providing an alarm-acknowledgment signal at the control console; and the control-console processing means responds to receipt of the alarm-acknowledgment signal by discontinuing provision of the alarm.

In some situations, the responsible person is away from the control console when an alarm is indicated and significant time may pass before the responsible person is able to return to the control console and react to the alarm. For example, on board a ship, the control console typically is in the engine room, the control room or the bridge, and the ship's engineer who is responsible for reacting to alarms frequently is away from the location of the control console to attend to other shipboard duties when an alarm is sounded throughout the ship.

SUMMARY OF THE INVENTION

The present invention enables a person to remotely observe the monitored measurement data without having to go to the control console each time he wishes to observe such data.

The present invention provides a remote monitoring system, comprising a control console and a portable monitoring unit; wherein the control console, includes processing means for processing measurement data related to a plurality of monitored parameters and for responding to a request for transmission of measurement data pertaining to a parameter selected from said plurality of monitored parameters by causing a radio coupled to the control-console processing means to transmit said selected-parameter measurement data; and wherein the portable monitoring unit includes a display device; a keypad for selecting a said parameter as to which measurement data is to be displayed by the display device and for enabling said measurement data that is to be displayed to be requested from the control-console processing means; a radio for transmitting a said request to the radio that is coupled to the control console and for receiving said measurement data transmitted by the radio that is coupled to the control console; and a processor coupled to the keypad, the portable-unit radio and the display device, and adapted for responding to an operation of the keypad to select a parameter as to which measurement data requested from the control-console processing means is to be displayed by causing the portable-unit radio to transmit to the radio coupled to the control console a request for transmission of said measurement data selected by operation of the keypad and for causing the display device to display said measurement data that is received by the portable-unit radio.

The present invention also provides a portable monitoring unit for remotely monitoring measurement data provided at a control console that includes processing means for processing measurement data related to a plurality of monitored parameters and for responding to a request for transmission of measurement data pertaining to a parameter selected from said plurality of monitored parameters by causing a radio coupled to the control-console processing means to transmit said selected-parameter measurement data, the portable unit comprising a display device; a keypad for selecting a said parameter as to which measurement data is to be displayed by the display device and for enabling said measurement data that is to be displayed to be requested from the control-console processing means; a radio for transmitting a said request to the radio that is coupled to the control console and for receiving said measurement data transmitted by the radio that i coupled to the control console; and a processor coupled to the keypad, the portable-unit radio and the display device, and adapted for responding to an operation of the keypad to select a parameter as to which measurement data requested from the control-console processing means is to be displayed by causing the portable-unit radio to transmit to the radio coupled to the control console a request for transmission of said measurement data selected by operation of the keypad and for causing the display device to display said measurement data that is received by the portable-unit radio.

In another aspect, the present invention provides a remote monitoring system, comprising a control console and a portable monitoring unit, wherein the control console, includes processing means for processing measurement data related to a monitored parameter in relation to a predetermined parameter threshold, for providing an alarm-condition signal upon said processed measurement data reaching said parameter threshold, and for causing a radio coupled to the control console to transmit said alarm-condition signal; and wherein the portable monitoring unit includes a radio for receiving said alarm-indication signal transmitted by the radio that is coupled to the control console; means for providing an alarm; a display device; a processor coupled to the portable-unit radio, the alarm providing means and the display device, and adapted for responding to receipt of a said alarm-condition signal by the portable-unit radio by causing the alarm providing means to provide an alarm and by causing the display device to display said alarm condition; a keypad for enabling said measurement data to be requested from the control-console processing means; wherein the portable-unit processor is adapted for responding to an operation of the keypad to request said measurement data from the control-console processing means by causing the portable-unit radio to transmit to the radio coupled to the control console a request for transmission of said measurement data; wherein the control-console processing means is adapted for responding to receipt by the radio coupled to the control console of said request for said measurement data by causing the radio coupled to the control-console processing means to transmit said requested measurement data to the portable-unit radio; and wherein the portable-unit processor is adapted for responding to receipt by the portable-unit radio of said requested measurement data by causing the display device to display said requested measurement data that is received by the portable-unit radio in response to said request.

In a preferred embodiment of this aspect of the present invention, the portable-unit keypad is adapted for enabling selection of an alarm-acknowledgment signal for transmission to the control console; the portable-unit processor is adapted for responding to operation of the keypad to select said alarm-acknowledgment signal for transmission by causing the portable-unit radio to transmit said alarm-acknowledgment signal to the radio coupled to the control console; and the control-console processing means is adapted for responding to receipt of said alarm-acknowledgment signal by the radio that is coupled to the control-console processing means by discontinuing provision of said alarm-condition signal.

Additional features of the present invention are described with reference to the detailed description of the preferred embodiments.

DETAILED DESCRIPTION

Figure 1A:
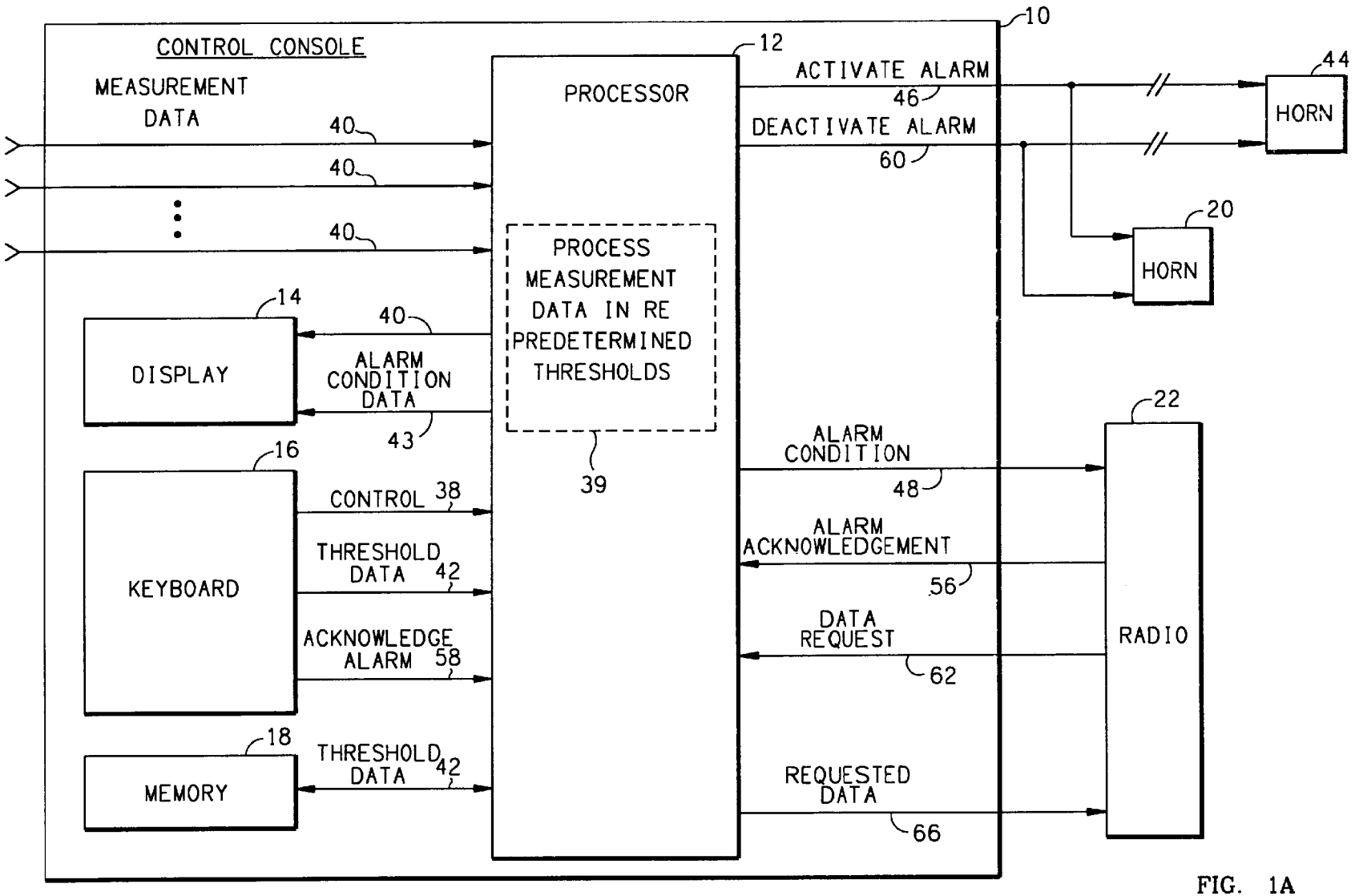
FIG. 1A is a functional block diagram of the control console portion of a preferred embodiment of the remote monitoring system of the present invention.

Referring to FIG. 1A, a control console 10 includes a processor 12 and a display device 14, a keyboard 16, a memory 18 a horn 20 and a lamp (not shown), all of which are coupled to the processor 12. A two-way radio 22 also is coupled to the control-console processor 12.

Figure 2:
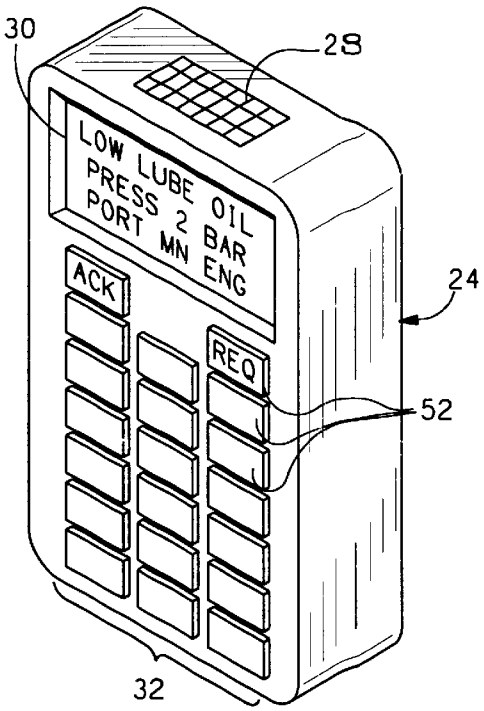
FIG. 2 is a perspective view of a preferred embodiment of the portable monitoring unit of the present invention.
Figure 1B:
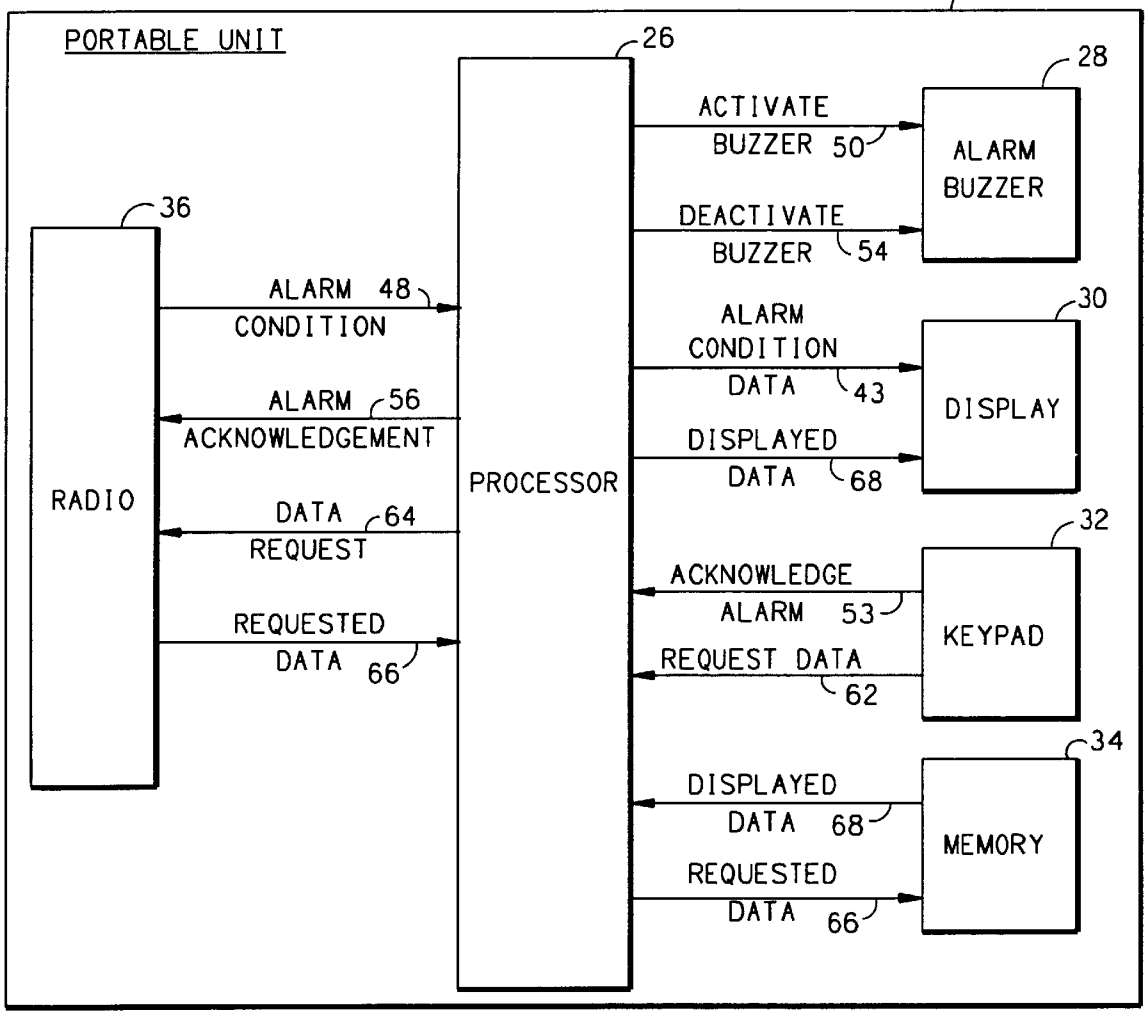
FIG. 1B is a functional block diagram of the portable monitoring unit portion of a preferred embodiment of the remote monitoring system of the present invention.

Referring to FIGS. 1B and 2, a portable monitoring unit 24 includes a processor 26 and an alarm buzzer 28, a display device 30, a keypad 32, a memory 34 and a two-way radio 36, all of which are coupled to the processor 26.

In one preferred embodiment, the control console 10 is in the engine room, the control room or the bridge of a ship and the monitored parameters pertain to operation of the ship.

The control-console processor 12 is controlled in response to control signals 38 provided by operation of the keyboard 16. The control-console processor 12 is adapted for performing a data processing routine 39 of processing measurement data 40 related to a plurality of monitored parameters, such as temperature, pressure and fluid level, in relation to predetermined parameter thresholds 42 that are specified by operation of the keyboard 16. The threshold data specified by operation of the keyboard 16 is stored in the control-console memory 18 and accessed therefrom for processing by the control-console processor 12. Selected measurement data 40 is displayed by the control-console display device 14 in accordance with operation of the keyboard 16.

The control-console processor 12 indicates an alarm condition upon the processed measurement data 40 reaching a said parameter threshold 42. The control-console processor 12 causes alarm-condition data 43 including data identifying the monitored parameter associated with the alarm condition and measurement data 40 for the monitored parameter associated with the alarm condition to be automatically displayed on the control-console display device 16.

The control-console processor 12 is coupled to the horn 20 and at least one other horn 44 and to other alarm-providing means, including lamps (not shown). The horn 44 and at least one of the lamps are disposed remotely from the control console 10 at locations where an alarm sounded by the horn 20 at the control console 10 could not be heard. Upon indicating an alarm condition, the control-console processor 12 provides an "activate alarm" signal 46 to both the horn 20 and the remotely located horn 44 and to the lamps to cause the horns 20, 44 to sound and the lamps to provide a flashing light.

Upon indicating an alarm condition, the control-console processor 12 also provides an alarm-condition signal 48 to the radio 22 coupled thereto and causes the radio 22 to transmit the alarm condition signal 48 to the portable monitoring unit 24. The alarm condition signal 48 includes a first portion indicating an alarm condition, a second portion identifying the monitored parameter associated with the alarm condition and a third portion containing measurement data for the monitored parameter associated wit the alarm condition.

The portable monitoring unit radio 36 receives the transmitted alarm-indication signal 48 and provides the same to the portable-unit processor 26.

The portable-unit processor 26 is adapted for responding to receipt of the alarm-condition signal 48 by providing an "activate buzzer" signal 50 to the alarm buzzer 28 to thereby cause the alarm buzzer 28 to sound an alarm, and by providing to the portable-unit display device 30 alarm condition data 43 extracted from the alarm-condition signal 48 to thereby cause the display device 30 to display the alarm condition. The extracted alarm condition data 43 includes the second and third portions of the alarm-condition signal 48, to wit: data identifying the monitored parameter associated with the alarm condition and measurement data for the monitored parameter associated with the alarm condition. Referring to FIG. 2, an exemplary display of the alarm condition data by the display device 30 reads "LOW LUBE OIL PRESS 2 BAR PORT MN ENG", which indicates that the lubricating oil pressure of the port-side main engine is low and that such pressure if 2 times the normal atmospheric pressure, or approximately 29.4 psig.

The portable-unit keypad includes a key "ACK" for enabling acknowledgment of an alarm, a key "REQ" for enabling measurement data to be requested from the control-console processor 12, and an array of keys 52 for selecting the measurement data that is requested from the control-console processor 12.

Selection of the ACK key provides an acknowledge alarm signal 53 from the keypad 32 to the portable-unit processor 26; and the portable-unit processor 26 responds thereto by providing a "deactivate buzzer" signal 54 to the alarm buzzer 28 to thereby deactivate the alarm buzzer 28. The portable-unit processor 26 also responds to the alarm acknowledge signal 53 from the keypad 32 by providing an alarm-acknowledgment signal 56 to the portable-unit radio 36 for transmission to the radio 22, which is coupled to the control console 10.

The radio 22 coupled to the control console 10 receives the transmitted alarm-acknowledgment signal 56 and provides the same to the control-console processor 12. The control-console processor 12 is adapted for responding to receipt of the alarm-acknowledgment signal 56 by discontinuing provision of the alarm-condition signal 48. The control-console processor 12 is also adapted for discontinuing provision of the alarm-condition signal 48 in response to an acknowledge alarm signal 58 provided by operation of the keyboard 16. The control-console processor 12 further responds to either the alarm-acknowledgment signal 56 or the acknowledge alarm signal 58 by providing a "deactivate alarm" signal 60 to the horns 20, 44 and the lamps, to thereby turn off the horns 20, 44 and stop the lamps from flashing.

Selection of the REQ key in combination with selection of one of the parameter selection keys 52 provides a request data signal 62 from the keypad 32 to the portable-unit processor 26; and the portable-unit processor 26 responds thereto by providing a data request signal 64 to the portable-unit radio 36 for transmission to the radio 22, which is coupled to the control console 10. The data request signal 64 includes a first portion including a request for transmission of measurement data from the control console 10 to the portable unit 24 and a second portion identifying the parameter for which the measurement data is requested.

The radio 22 coupled to the control console 10 receives the transmitted data request signal 64 and provides the same to the control-console processor 12. The control-console processor 12 is adapted for responding to receipt of the data request signal 64 by causing the radio 22 coupled to the control-console processor 12 to transmit the requested measurement data 66 to the portable unit 24.

The portable-unit radio 36 receives the transmitted requested measurement data 66 and provides the same to the portable-unit processor 26. The portable-unit processor 26 is adapted for responding to receipt of the requested measurement data 66 by causing the portable-unit display device 30 to display the requested measurement data 66 that is received in response to the data request signal 64. The received measurement data is stored in the portable-unit memory 34 and the displayed data 68 is retrieved from said memory 34.

Measurement data 68 for a given parameter previously stored in the portable-unit memory 34 can be accessed by the portable-unit processor 26 for display by the portable-unit display device 30 by selecting only the key 52 on the portable-unit keypad 32 that identifies such given parameter. Measurement data 68 for all of the monitored parameters can be stored in the portable unit memory 34 prior to any alarm condition by requesting such data so that when an alarm condition is indicated, for parameters other than the parameter for which the alarm condition is indicated, one can access the portable unit memory 34 to obtain a display of the measurement data for a given monitored parameter that was measured prior to the alarm condition and then request current data for such given monitored parameter in order to ascertain the extent of any change in such given monitored parameter upon the current data being displayed in response to such request.

The portable-unit processor 26 is adapted for responding to receipt of an alarm-condition signal 48 by causing the portable-unit display device 30 to display the alarm condition data 43 in preference to any previously requested selected-parameter measurement data 66.

The portable-unit processor 26 is also adapted for responding to selection of a parameter as to which measurement data 68 is to be displayed by selecting a parameter selection key 52 on the keypad 32, either alone or in combination with the REQ key, by causing the portable-unit display device 30 to display the selected-parameter measurement data 68 in preference to any alarm condition data 43 displayed in response to a previously received alarm-condition signal 56.

The control-console processor 12 is adapted for responding to a second provision of an alarm-condition signal 48 after a previous provision of an alarm-condition signal 48 pertaining to a different monitored parameter by causing the radio 22 to transmit the second provided alarm-condition signal 48 in preference to the previously provided alarm-condition signal 48.

In an alternative preferred embodiment, in which a prior art control console is retrofitted in accordance with the present invention, the control-console processor 12 includes both the processor of the prior art control console and a second processor coupled thereto to accomplish the processing provided by the control-console processor 12 in the above-described preferred embodiment that is not provided by the prior art control-console processor. In such alternative preferred embodiment, the second processor rather than the prior art control-console processor is coupled to the radio 22; the measurement data 40 is provided to both processors; the alarm condition data 43 and the measurement data 40 for the parameter for which the alarm is indicated are provided by the prior art control-console processor to the second processor, which incorporates such data into an alarm condition signal 48 that is provided to the radio 22 for transmission; the second processor provides the alarm acknowledgment signal 56 received by the radio 22 to the prior art control-console processor; the second processor responds to a data request signal 62 received by the radio 22 by providing a requested data signal 66 to the radio 22 for transmission; and the prior art control-console processor responds to control signals 38, the threshold data 42 and the alarm acknowledgment signals 56, 58, exchanges threshold data with the memory 18, processes measurement data 40 in relation to threshold data 42 in accordance with processing routine 39, indicates an alarm condition upon the processed measurement data 40 reaching a relevant parameter threshold 42, provides the activate alarm signal 46 and the deactivate alarm signal 60 to the horns 20, 44, and provides the alarm condition data 43 and the measurement data 40 for the parameter for which the alarm is indicated to the display 14 in the same manner as the control-console processor 12 performs such functions in the above-described preferred embodiment.

In other preferred embodiments, the present invention is applicable for remotely monitoring measurement data provided at control consoles in various environments, such as in a power plant, for example.

While the above description contains many specificities, these should not be construed as limitations on the scope of the present invention, but rather as exemplifications of the preferred embodiments described herein. Other variations are possible and the scope of the present invention should be determined not by the embodiments described herein but rather by the claims and their legal equivalents.

What is claimed is:

1. A portable monitoring unit for remotely monitoring measurement data provided at a control console that includes processing means for processing measurement data related to a plurality of monitored parameters and for responding to a request for transmission of measurement data pertaining to a parameter selected from said plurality of monitored parameters by causing a radio coupled to the control-console processing means to transmit said selected-parameter measurement data, and for displaying an alarm condition indicated by the control-console processing means and transmitted by the radio that is coupled to the control console, the portable unit comprising a display device;

a keypad for selecting said parameter as to which measurement data is to be displayed by the display device and for enabling said measurement data that is to be displayed to be requested from the control-console processing means;

a radio for transmitting a said request to the radio that is coupled to the control console and for receiving said measurement data transmitted by the radio that is coupled to the control console;

a processor coupled to the keypad, the portable-unit radio and the display device, and adapted for responding to an operation of the keypad to select a parameter as to which measurement data requested from the control-console processing means is to be displayed by causing the portable-unit radio to transmit to the radio coupled to he control console a request for transmission of said measurement data selected by operation of the keypad and for causing the display device to display said measurement data that is received by the portable-unit radio; and means other than the display device for providing an alarm;

wherein the portable-unit processor is also coupled to the alarm providing means and is adapted for responding to receipt of an alarm-condition signal by the portable-unit radio by causing the alarm providing means to provide an alarm and by causing the display device to display said alarm condition; and wherein the portable-unit processor is also adapted for responding to receipt of an alarm-condition signal by the portable-unit radio by causing the display device to display said alarm condition in preference to any previously so requested said selected-parameter measurement data.

2. A portable monitoring unit for remotely monitoring measurement data provided at a control console that includes processing means for processing measurement data related to a plurality of monitored parameters and for responding to a request for transmission of measurement data pertaining to a parameter selected from said plurality of monitored parameters by causing a radio coupled to the control-console processing means to transmit said selected-parameter measurement data, and for displaying an alarm condition indicated by the control-console processing means and transmitted by the radio that is coupled to the control console, the portable unit comprising a display device;

a keypad for selecting said parameter as to which measurement data is to be displayed by the display device and for enabling said measurement data that is to be displayed to be requested from the control-console processing means;

a radio for transmitting a said request to the radio that is coupled to the control console and for receiving said measurement data transmitted by the radio that is coupled to the control console;

a processor coupled to the keypad, the portable-unit radio and the display device, and adapted for responding to an operation of the keypad to select a parameter as to which measurement data requested from the control-console processing means is to be displayed by causing the portable-unit radio to transmit to the radio coupled to the control console a request for transmission of said measurement data selected by operation of the keypad and for causing the display device to display said measurement data that is received by the portable-unit radio; and means other than the display device for providing an alarm;

wherein the portable-unit processor is also coupled to the alarm providing means and is adapted for responding to receipt of an alarm-condition signal by the portable-unit radio by causing the alarm providing means to provide an alarm and by causing the display device to display said alarm condition;

wherein the keypad is adapted for enabling selection of an alarm-acknowledgment signal for transmission to the control console; and wherein the portable-unit processor is adapted for responding to operation of the keypad to select said alarm acknowledgment signal for transmission by causing the portable-unit radio to transmit said alarm-acknowledgment signal to the radio coupled to the control console.

3. A portable monitoring unit for remotely monitoring measurement data provided at a control console that includes processing means for processing measurement data related to a plurality of monitored parameters and for responding to a request for transmission of measurement data pertaining to a parameter selected from said plurality of monitored parameters by causing a radio coupled to the control-console processing means to transmit said selected-parameter measurement data, the portable unit comprising a display device;

a keypad for selecting said parameter as to which measurement data is to be displayed by the display device and for enabling said measurement data that is to be displayed to be requested from the control-console processing means;

a radio for transmitting a said request to the radio that is coupled to the control console and for receiving said measurement data transmitted by the radio that is coupled to the control console;

a processor coupled to the keypad, the portable-unit radio and the display device, and adapted for responding to an operation of the keypad to select a parameter as to which measurement data requested from the control-console processing means is to be displayed by causing the portable-unit radio to transmit to the radio coupled to the control console a request for transmission of said measurement data selected by operation of the keypad and for causing the display device to display said measurement data that is received by the portable-unit radio; and a memory for storing said measurement data received by the portable-unit radio;

wherein the keypad is adapted for enabling selection of said parameter as to which measurement data from the memory is to be displayed by the display device; and wherein the portable-unit processor is also coupled to the memory and is adapted for causing said measurement data related to a plurality of said monitored parameters received by the portable-unit radio to be stored in the memory and for responding to an operation of the keypad to select said parameter as to which measurement data form the memory is to be displayed by causing the display device to display said measurement data for the selected parameter from the memory by said operation of the keypad.

4. A remote monitoring system, comprising a control console and a portable monitoring unit, wherein the control console, includes processing means for processing measurement data related to a plurality of monitored parameters and for responding to a request for transmission of measurement data pertaining to a parameter selected from said plurality of monitored parameters by causing a radio coupled to the control-console processing means to transmit said selected parameter measurement data; and wherein the portable monitoring unit includes a display device;

a keypad for selecting said parameter as to which measurement data is to be displayed by the display device and for enabling said measurement data that is to be displayed to be requested from the control-console processing means;

a radio for transmitting a said request to the radio that is coupled to the control console and for receiving said measurement data transmitted by the radio that is coupled to the control console; and a processor coupled to the keypad, the portable-unit radio and the display device and adapted for responding to an operation of the keypad to select a parameter as to which measurement data requested from the control-console processing means is to be displayed by causing the portable-unit radio to transmit to the radio coupled to the control console a request for transmission of said measurement data selected by operation of the keypad and for causing the display device to display said measurement data that is received by the portable-unit radio;

wherein the control-console processing means is adapted for processing said measurement data in relation to predetermined parameter thresholds, for providing an alarm-condition signal upon said processed measurement data, reaching said parameter threshold, and for causing the radio coupled to the control console to transmit said alarm-condition signal to the portable-unit radio;

wherein the portable unit further includes means other than the display device for providing an alarm;

wherein the portable-unit processor is also coupled to the alarm providing means and is adapted for responding to receipt of a said alarm-condition signal by the portable-unit radio by causing the alarm providing means to provide an alarm and by causing the display device to display said alarm condition; and wherein the control-console processing means is adapted for responding to said processed measurement data reaching said parameter threshold by causing the radio coupled to the control console to transmit said alarm-condition signal to the portable-unit radio in preference to any previously so requested said measurement data.

5. A remote monitoring system, comprising a controls console and a portable monitoring unit, wherein the control console, includes processing means for processing measurement data related to a plurality of monitored parameters and for responding to a request for transmission of measurement data pertaining to a parameter selected from said plurality of monitored parameters by causing a radio coupled to the control-console processing means to transmit said selected-parameter measurement data; and wherein the portable monitoring unit includes a display device;

a keypad for selecting said parameter as to which measurement data is to be displayed by the display device and for enabling said measurement data that is to be displayed to be requested from the control-console processing means;

a radio for transmitting a said request to the radio that is coupled to the control console and for receiving said measurement data transmitted by the radio that is coupled to the control console; and a processor coupled to the keypad, the portable-unit radio and the display device, and adapted for responding to an operation of the keypad to select a parameter as to which measurement data requested from the control-console processing means is to be displayed by causing the portable-unit radio to transmit to the radio coupled to the control console a request for transmission of said measurement data selected by operation of the keypad and for causing the display device to display said measurement data that is received by the portable-unit radio;

wherein the control-console processing means is adapted for processing said measurement data in relation to predetermined parameter thresholds, for providing an alarm-condition signal upon said processed measurement data reaching said parameter threshold, and for causing the radio coupled to the control console to transmit said alarm-condition signal to the portable-unit radio;

wherein the portable unit further includes means other than the display device for providing an alarm;

wherein the portable-unit processor is also coupled to the alarm providing means and is adapted for responding to receipt of a said alarm-condition signal by the portable-unit radio by causing the alarm providing means to provide an alarm and by causing the display device to display said alarm condition; and wherein the control-console processing means is adapted for responding to said processed measurement data reaching said parameter threshold by causing the radio coupled to the control console to transmit to the portable-unit radio in real time said measurement data for said parameter for which said threshold was reached in preference to any previously so requested said measurement data.

6. A remote monitoring system, comprising a control console and a portable monitoring unit wherein the control console, includes processing means for processing measurement data related to a plurality of monitored parameters and for responding to a request for transmission of meausremeent data pertaining to a parameter selected from said plurality of monitored parameters by causing a radio coupled to the control-console processing means to transmit said selected-parameter measurement data; and wherein the portable monitoring unit includes a display device;

a keypad for selecting said parameter as to which measurement data is to be displayed by the display device and for enabling said measurement data that is to be displayed to be requested from the control-console processing means;

a radio for transmitting a said request to the radio that is coupled to the control console and for receiving said measurement data transmitted by the radio that is coupled to the control console; and a processor coupled to the keypad, the portable-unit radio and the display device, and adapted for responding to an operation of the keypad to select a parameter as to which measurement data requested from the control-console processing means is to be displayed by causing the portable-unit radio to transmit to the radio coupled to the control console a request for transmission of said measurement data selected by operation of the keypad and for causing the display device to display said measurement data that is received by the portable-unit radio;

wherein the control-console processing means is adapted for processing said measurement data in relation to predetermined parameter thresholds, for providing an alarm-condition signal upon said processed measurement data reaching said parameter threshold, and for causing the radio coupled to the control console to transmit said alarm-condition signal to the portable-unit radio;

wherein the portable unit further includes means other than the display device for providing an alarm;

wherein the portable-unit processor is also coupled to the alarm providing means and is adapted for responding to receipt of a said alarm-condition signal by the portable-unit radio by causing the alarm providing means to provide an alarm and by causing the display device to display said alarm condition; and wherein the control-console processing means is adapted for responding to a second provision of an alarm-condition signal after a previous provision of said alarm-condition signal pertaining to a different monitored parameter by causing the radio coupled to the control-console processing means to transmit said second provided alarm-condition signal in preference to said previously provided alarm-condition signal.

7. A remote monitoring system, comprising a control console and a portable monitoring unit, wherein the control console, includes processing means for processing measurement data related to a plurality of monitored parameters and for responding to a request for transmission of measurement data pertaining to a parameter selected from said plurality of monitored parameters by causing a radio coupled to the control-console processing means to transmit said selected-parameter measurement data; and wherein the portable monitoring unit includes a display device;

a keypad for selecting said parameter as to which measurement data is to be displayed by the display device and for enabling said measurement data that is to be displayed to be requested from the control-console processing means;

a radio for transmitting a said request to the radio that is coupled to the control console and for receiving said measurement data transmitted by the radio that is coupled to the control console, and a processor coupled to the keypad, the portable-unit radio and the display device, and adapted for responding to an operation of the keypad to select a parameter as to which measurement data requested from the control-console processing means is to be displayed by causing the portable-unit radio to transmit to the radio coupled to the control console a request for transmission of said measurement data selected by operation of the keypad and for causing the display device to display said measurement data that is received by the portable-unit radio;

wherein the control-console processing means is adapted for processing said measurement data in relation to predetermined parameter thresholds, for providing an alarm-condition signal upon said processed measurement data reaching said parameter threshold, and for causing the radio coupled to the control console to transmit said alarm-condition signal to the portable-unit radio;

wherein the portable unit further includes means other than the display device for providing an alarm;

wherein the portable-unit processor is also coupled to the alarm providing means and is adapted for responding to receipt of a said alarm-condition signal by the portable-unit radio by causing the alarm providing means to provide an alarm and by causing the display device to display said alarm condition; and wherein the control-console processing means is adapted for responding to a said request for measurement data received by the radio coupled to the control console after the provision of said alarm-condition signal by causing the radio coupled to the control-console processing means to transmit said selected-parameter measurement data in preference to said previously provided alarm-condition signal.

8. A remote monitoring system, comprising a control console and a portable monitoring unit, wherein the control console, includes processing means for processing measurement data related to a plurality of monitored-parameters and for responding to a request for transmission of measurement data pertaining to a parameter selected from said plurality of monitored parameters by causing a radio coupled to the control-console processing means to transmit said selected-parameter measurement data; and wherein the portable monitoring unit includes a display device;

a keypad for selecting said parameter as to which measurement data is to be displayed by the display device and for enabling said measurement data that is to be displayed to be requested from the control-console processing means;

a radio for transmitting a said request to the radio that is coupled to the control console and for receiving said measurement data transmitted by the radio that is coupled to the control console; and a processor coupled to the keypad, the portable-unit radio and the display device, and adapted for responding to an operation of the keypad to select a parameter as to which measurement data requested from the control-console processing means is to be displayed by causing the portable-unit radio to transmit to the radio coupled to the control console a request for transmission of said measurement data selected by operation of the keypad and for causing the display device to display said measurement data that is received by the portable-unit radio;

wherein the control-console processing means is adapted for processing said measurement data in relation to predetermined parameter thresholds, for providing an alarm-condition signal upon said processed measurement data reaching said parameter threshold, and for causing the radio coupled to the control console to transmit said alarm-condition signal to the portable-unit radio;

wherein the portable unit further includes means other than the display device for providing an alarm;

wherein the portable-unit processor is also coupled to the alarm providing means and is adapted for responding to receipt of a said alarm-condition signal by the portable-unit radio by causing the alarm providing means to provide an alarm and by causing the display device to display said alarm condition;

wherein the portable-unit keypad is adapted for enabling selection of an alarm-acknowledgment signal for transmission to the control console;

wherein the portable-unit processor is adapted for responding to operation of the keypad to select said alarm-acknowledgment signal for transmission by causing the portable-unit radio to transmit said alarm-acknowledgment signal to the radio coupled to the control console; and wherein the control-console processing means is adapted for responding to receipt of said alarm-acknowledgment signal by the radio that is coupled to the control-console processing means by discontinuing provision of said alarm-condition signal.

9. A remote monitoring system, comprising a control console and a portable monitoring unit, wherein the control console, includes processing means for processing measurement data related to a plurality of monitored parameters and for responding to a request for transmission of measurement data pertaining to a parameter selected from said plurality of monitored parameters by causing a radio coupled to the control-console processing means to transmit said selected-parameter measurement data; and wherein the portable monitoring unit includes a display device;

a keypad for selecting said parameter as to which measurement data is to be displayed by the display device and for enabling said measurement data that is to be displayed to be requested from the control-console processing means;

a radio for transmitting a said request to the radio that is coupled to the control console and for receiving said measurement data transmitted by the radio that is coupled to the control console; and a processor coupled to the keypad, the portable-unit radio and the display device, and adapted for responding to an operation of the keypad to select a parameter as to which measurement data requested from the control-console processing means is to be displayed by causing the portable-unit radio to transmit to the radio coupled to the control console a request for transmission of said measurement data selected by operation of the keypad and for causing the display device to display said measurement data that is received by the portable-unit radio;

wherein the control console further comprise a memory and a display; and wherein the control-console processing means is adapted for causing said selected-parameter measurement data transmitted in response to said requests to be stored in the control-console memory and for causing said stored data to be retrieved from the control-console memory for display by the control-console display.

10. A remote monitoring system, comprising a control console and a portable monitoring unit, wherein the control console, includes processing means for processing measurement data related to a plurality of monitored parameters and for responding to a request for transmission of measurement data pertaining to a parameter selected from said plurality of monitored parameters by causing a radio coupled to the control-console processing means to transmit said selected-parameter measurement data; and wherein the portable monitoring unit includes a display device;

a keypad for selecting said parameter as to which measurement data is to be displayed by the display device and for enabling said measurement data that is to be displayed to be requested from the control-console processing means;

a radio for transmitting a said request to the radio that is coupled to the control console and for receiving said measurement data transmitted by the radio that is coupled to the control console;

a processor coupled to the keypad, the portable-unit radio and the display device, and adapted for responding to an operation of the keypad to select a parameter as to which measurement data requested from the control-console processing means is to be displayed by causing the portable-unit radio to transmit to the radio coupled to the control console a request for transmission of said measurement data selected by operation of the keypad and for causing the display device to display said measurement data that is received by the portable-unit radio; and a memory for storing said measurement data received by the portable-unit radio;

wherein the keypad is adapted for enabling selection of said parameter at to which measurement data from the memory is to be displayed by the display device; and wherein the portable-unit processor is also coupled to the memory and is adapted for causing said measurement data related to a plurality of said monitored parameters received by the portable-unit radio to be stored in the memory and for responding to an operation of the keypad to select said parameter as to which measurement data from the memory is to be displayed by causing the display device to display said measurement data for the selected parameter from the memory by said operation of the keypad.

11. A remote monitoring system, comprising a control console and a portable monitoring unit, wherein the control console, includes processing means for processing measurement data related to a plurality of monitored parameters and for responding to a request for transmission of measurement data pertaining to a parameter selected from said plurality of monitored parameters by causing a radio coupled to the control-console processing means to transmit said selected-parameter measurement data; and wherein the portable monitoring unit includes a display device;

a keypad for selecting said parameter as to which measurement data is to be displayed by the display device and for enabling said measurement data that is to be displayed to be requested from the control-console processing means;

a radio for transmitting a said request to the radio that is coupled to the control console and for receiving said measurement data transmitted by the radio that is coupled to the control console; and a processor coupled do the keypad, the portable-unit radio and the display device, and adapted for responding to an operation of the keypad to select a parameter as to which measurement data requested from the control-console processing means is to be displayed by causing the portable-unit radio to transmit to the radio coupled to the control console a request for transmission of said measurement data selected by operation of the keypad and for causing the display device to display said measurement data that is received by the portable-unit radio;

wherein the control console is in the engine room, the control room or the bridge of a ship and the monitored parameters pertain to operation of the ship;

wherein the control-console processing means is adapted for processing said measurement data in relation to predetermined parameter thresholds, for providing an alarm-condition signal upon said processed measurement data reaching said parameter threshold, and for causing the radio coupled to the control console to transmit said alarm-condition signal to the portable-unit radio;

wherein the portable unit further includes means for providing an alarm;

wherein the portable-unit processor is also coupled to the alarm providing means and is adapted for responding to receipt of said alarm-condition signal by the portable-unit radio by causing the alarm providing means to provide an alarm and by causing the display device to display said alarm condition;

wherein the portable-unit keypad is adapted for enabling selection of an alarm-acknowledgment signal for transmission to the control console;

wherein the portable-unit processor is adapted for responding to operation of the keypad to select said alarm-acknowledgment signal for transmission by causing the portable-unit radio to transmit said alarm-acknowledgement signal to the radio coupled to the control console; and wherein the control-console processing means is adapted for responding to receipt of said alarm-acknowledgment signal by the radio that is coupled to the control-console processing means by discontinuing provision of said alarm-condition signal.

12. A remote monitoring system, comprising a control console and a portable monitoring unit, wherein the control console, includes processing means for processing measurement data related to a monitored parameter in relation to a predetermined parameter threshold, for providing an alarm-condition signal upon said processed measurement data reaching said parameter threshold, and for causing a radio coupled to the control console to transmit said alarm-condition signal; and wherein the portable monitoring unit includes a radio for receiving said alarm-condition signal transmitted by the radio that is coupled to the control console;

a display device;

means other than the display device for providing an alarm;

a processor coupled to the portable-unit radio, the alarm providing means and the display device, and adapted for responding to receipt of said alarm-condition signal by the portable-unit radio by causing the alarm providing means to provide an alarm and by causing the display device to display said alarm condition;

a keypad for enabling said measurement data to be requested from the control-console processing means;

wherein the portable-unit processor is adapted for responding to an operation of the keypad to request said measurement data from the control-console processing means by causing the portable-unit radio to transmit to the radio coupled to the control console a request for transmission of said measurement data;

wherein the control-console processing means is adapted for responding to receipt by the radio coupled to the control console of said request for said measurement data by causing the radio couple to the control-console processing means to transmit said requested measurement data to the portable-unit radio;

wherein the portable-unit processor is adapted for responding to receipt by the portable-unit radio of said requested measurement data by causing the display device to display said requested measurement data that is received by the portable-unit radio in response to said request;

wherein the portable-unit keypad is adapted for enabling selection of an alarm-acknowledgment signal for transmission to the control console;

wherein the portable-unit processor is adapted for responding to operation of the keypad to select said alarm-acknowledgment signal for transmission by causing the portable-unit radio to transmit said alarm-acknowledgment signal to the radio coupled to the control console; and wherein the control-console processing means is adapted for responding to receipt of said alarm-acknowledgment signal by the radio that is coupled to the control-console processing means by discontinuing provision of said alarm-condition signal.

* * * * *

UNITED STATES PATENT AND TRADEMARK OFFICE

CERTIFICATE OF CORRECTION

PATENT NO. : 6,525,664 B1
DATED : February 25, 2003
INVENTOR(S) : Michael J. Erland It is certified that error appears in the above-identified patent and that said Letters Patent is hereby corrected as shown below:

Column 2,
Line 21, “i” should be -- is --.

Column 4,
Line 17, “wit” should be -- with --.
Line 39, “if” should be -- is --.

Column 7,
Line 14, “he” should be -- the --.

Column 8,
Line 59, “form” should be -- from --.

Column 9,
Line 51, “controls” should be -- control --.

Column 13,
Line 48, “comprise” should be -- comprises --.

Column 14,
Line 60, “do” should be -- to --.

Column 16,
Line 24, “couple” should be -- coupled --.

Signed and Sealed this

Fifth Day of August, 2003

JAMES E. ROGAN
*Director of the United States Patent and Trademark Office*